US011993356B2

(12) United States Patent
Rydell et al.

(10) Patent No.: US 11,993,356 B2
(45) Date of Patent: May 28, 2024

(54) NOSE ARRANGEMENT AND METHOD FOR DEPLOYING A NOSE ARRANGEMENT OF AN UNDERWATER VEHICLE

(71) Applicant: SAAB AB, Linköping (SE)

(72) Inventors: Anders Rydell, Linköping (SE); Torbjörn Green, Sturefors (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 18/259,955

(22) PCT Filed: Jan. 19, 2022

(86) PCT No.: PCT/SE2022/050058

§ 371 (c)(1),
(2) Date: Jun. 29, 2023

(87) PCT Pub. No.: WO2022/159021

PCT Pub. Date: Jul. 28, 2022

(65) Prior Publication Data

US 2023/0391435 A1 Dec. 7, 2023

(30) Foreign Application Priority Data

Jan. 21, 2021 (SE) ..... 2100009-6

(51) Int. Cl.
*B63G 8/22* (2006.01)
*B63G 8/00* (2006.01)
(Continued)

(52) U.S. Cl.
CPC ..... *B63G 8/22* (2013.01); *B63G 8/001* (2013.01); *B63G 8/04* (2013.01); *F42B 19/125* (2013.01); *B63G 2008/002* (2013.01)

(58) Field of Classification Search
CPC . B63G 8/00; B63G 8/001; B63G 8/04; B63G 8/22; B63G 2008/002; F42B 19/125
(Continued)

(56) References Cited

U.S. PATENT DOCUMENTS 2,596,120 A 5/1952 Boyle
3,419,926 A 1/1969 Adam
(Continued)

FOREIGN PATENT DOCUMENTS

CN 104670444 B 3/2017
DE 435562 C 10/1926
(Continued)

OTHER PUBLICATIONS

International Searching Authority, International Search Report and Written Opinion received for Application No. PCT/SE2022/050058, dated Mar. 7, 2022, 13 pages, Swedish Patent and Registration Office, Sweden.

(Continued)

*Primary Examiner* — Lars A Olson
(74) *Attorney, Agent, or Firm* — Alston & Bird LLP

(57) ABSTRACT

The present disclosure relates to a nose arrangement (100) for an underwater vehicle (10). The nose arrangement comprises a first separation section (110) comprising a first inflatable structure (113) and a second inflatable structure (114) arranged within the first inflatable structure (113). The first separation section (110) is arranged store the first inflatable structure (113) and the second inflatable structure (114) in a first state, and to inflate the first inflatable structure (113) and the second inflatable structure (114) in a second state. The first inflatable structure (113) is arranged to protrude along the longitudinal axis of the nose arrangement and underwater vehicle in the second state. The disclosure also relates to a method for deploying a nose arrangement (100) of an underwater vehicle.

27 Claims, 4 Drawing Sheets

(51) Int. Cl.
*B63G 8/04* (2006.01)
*F42B 19/12* (2006.01)

(58) Field of Classification Search
USPC ..... 114/339
See application file for complete search history.

(56) References Cited

U.S. PATENT DOCUMENTS

| | | | | |
|---|---|---|---|---|
| 4,328,601 | A | 5/1982 | Rodler, Jr. et al. | |
| 5,092,222 | A | 3/1992 | Lynch | |
| 5,235,128 | A | 8/1993 | Hardesty et al. | |
| 5,522,337 | A | 6/1996 | Meyers et al. | |
| 6,536,365 | B1 | 3/2003 | Horton | |
| 8,912,423 | B1 | 12/2014 | Gotzmer et al. | |
| 10,180,027 | B2 * | 1/2019 | Gandhi | E06B 3/481 |
| 11,046,403 | B2 | 6/2021 | Meyer et al. | |

FOREIGN PATENT DOCUMENTS

| | | | |
|---|---|---|---|
| GB | 2343416 | A | 5/2000 |
| WO | WO 2019/011831 | A1 | 1/2019 |

OTHER PUBLICATIONS

Swedish Patent and Registration Office, Office Action and Search Report received for Application No. 2100009-6, dated Sep. 2, 2021, 7 pages, Sweden.

* cited by examiner

NOSE ARRANGEMENT AND METHOD FOR DEPLOYING A NOSE ARRANGEMENT OF AN UNDERWATER VEHICLE

CROSS REFERENCE TO RELATED APPLICATIONS

This application is a National Stage Application, filed under 35 U.S.C. § 371, of International Application No. PCT/SE2022/050058, filed Jan. 19, 2022, which international application claims priority to and the benefit of Swedish Application No. 2100009-6, filed Jan. 21, 2021; the contents of both of which are hereby incorporated by reference in their entirety.

TECHNICAL FIELD

The present disclosure relates to a nose arrangement for an underwater vehicle and to a method for deploying a nose arrangement of an underwater vehicle.

BACKGROUND ART

It is desirable that an underwater vehicle, such as a torpedo, has a hydrodynamic nose portion in order to provide an efficient travel of the underwater vehicle through the sea. At the same time, a longitudinally extending nose portion of the underwater vehicle may, due to its length, cause storage problems in confined spaces, such as a submarine, before launch of the underwater vehicle into the sea.

In order to provide an efficient way to store the underwater vehicle before launch and at the same time provide an underwater vehicle with hydrodynamic properties, the underwater vehicle may be provided with a nose portion which is deployed after release of the underwater vehicle into the sea. Such a deployable nose portion may for example be inflatable such that the nose portion is inflated after launch of the underwater vehicle.

An example of an underwater vehicle comprising a deployable nose portion is disclosed in U.S. Pat. No. 5,522,337 B1.

However, when the underwater vehicle travels at high speeds after that the nose portion has been inflated, the shape of the nose portion may be deformed which thus affects the hydrodynamic properties of the underwater vehicle. Further, it is desirable that the buoyancy of the underwater vehicle as well as of a payload being released from the underwater vehicle may be controlled.

There is thus need for an improved nose arrangement which has improved hydrodynamic and buoyancy properties.

SUMMARY OF THE INVENTION

An object of the present disclosure is to provide a solution for a nose arrangement wherein some of the above identified problems are mitigated or at least alleviated.

The present disclosure proposes a nose arrangement for an underwater vehicle. The nose arrangement comprises a first separation section. The first separation section comprises a first inflatable structure and a second inflatable structure arranged within the first inflatable structure. The first separation section is arranged store the first inflatable structure and the second inflatable structure in a first state, and to inflate the first inflatable structure and the second inflatable structure in a second state. The first inflatable structure is arranged to protrude along the longitudinal axis of the nose arrangement and underwater vehicle in the second state.

An advantage of inflating the first inflatable structure and the second inflatable is that the separation section may be provided with a desired hydrodynamic shape, such as a convex shape, in the second state.

A further advantage is that by inflating the first inflatable structure and the second inflatable structure, control of the buoyancy of the separation section, i.e. if the separation section, should sink, float or be neutral in the water is enabled.

According to some aspects, the nose arrangement further comprises a releasable section.

The releasable section may for example be arranged to protect the first separation section, such as a cap sealing off the first separation section containing the first and second inflatable structures.

According to some aspects, the first inflatable structure and the second inflatable structure are arranged to be inflated in response to release of the releasable section from the nose arrangement.

Thereby, the underwater vehicle may be provided with a hydrodynamic front section of the nose arrangement after release of the releasable section.

According to some aspects, at least one separation section is arranged to be releasably attached to the underwater vehicle.

The nose arrangement may be arranged to release at least one separation section from the underwater vehicle. Thus, at least one separation section comprising at least one payload may be deployed at the seabed.

According to some aspects, at least one separation section is arranged to be fixedly attached to the underwater vehicle.

This may be advantageously, for example in order to save space when an underwater vehicle comprising the nose arrangement is stored in a confined space, such as a submarine, since a front section of the nose arrangement may be deployed after release of the underwater vehicle from the confined space.

According to some aspects, the nose arrangement further comprises a second separation section attached the first separation section, wherein the first separation section is positioned in front of the second separation section along a longitudinal axis of the nose arrangement and underwater vehicle while attached. The second separation section is arranged store a first inflatable structure and a second inflatable structure, wherein the second inflatable structure is arranged within the first inflatable structure, in a first state. The second separation section is arranged to inflate the first inflatable structure and the second inflatable structure in response to release of the first separation section from the nose arrangement in a second state. The first inflatable structure of the second separation section is arranged to protrude in the longitudinal axis of the nose arrangement and underwater vehicle in the second state.

The nose arrangement may comprise a plurality of separation sections which may be released from the underwater vehicle.

An advantage of a nose arrangement comprising a plurality of separation sections is that thereby, a plurality of separation sections comprising payloads may be deployed onto the seabed by one nose arrangement. Each of the separation sections may have all effects and advantages as discussed above.

According to some aspects, the first inflatable structure of each of the separation sections is arranged to be inflated by ambient water.

By inflating the first separation section by ambient water, space is saved since no containers with water, gas or liquid has to be stored in the underwater vehicle and/or separation section for inflation of the first inflatable structure.

According to some aspects, the second inflatable structure of each of the separation sections is arranged to be inflated by a gas or by a liquid.

An advantage of allowing the inflatable structures to be filled with medium of different density, such as gas or fluid, allows for controlling the relation between weight and volume of the underwater vehicle and/or of the separation section. A further advantage of allowing the inflatable structures to be filled with medium of different density is the ability to control the buoyancy of the separation section and/or the underwater vehicle to move towards the seabed or towards the water surface by controlling the pressure within the first inflatable structure and/or the second inflatable structure.

An advantage of inflating the second inflatable structure by gas is that it may be possible to find the separation sections being released from the underwater vehicle by means of sonar.

According to some aspects, a first pressure within the first inflatable structure and/or a second pressure within the second inflatable structure of each of the separation sections is controlled in the second state.

Thereby, the relation between weight and volume, i.e. the density, of the underwater vehicle and/or of the separation section may be controlled, thus providing a dynamic buoyancy of the separation section and/or the underwater vehicle. By means for controlling the pressure, a dynamic buoyancy of each of the separation sections and/or the underwater vehicle is provided.

Due to the dynamic buoyancy of the underwater vehicle and/or of the separation section, by increasing/decreasing the buoyancy of the separation section, data collection at different water layers and/or depths are enabled.

The pressure inside the inflatable structures comprised in separation sections may for example be controlled based on the speed of the underwater vehicle such that the desired hydrodynamic shape of the first inflatable structure in the second state is maintained.

Recovery of a releasable section being deployed on the seabed is enabled since the separation section may ascend to the surface by increasing the buoyancy of the separation section. The buoyancy may be controlled by controlling the pressure within the first and/or second inflatable structure(s).

According to some aspects, the pressure within the second inflatable structure of each of the separation sections in the second state is different as compared to the pressure within the first inflatable structure.

By maintaining a pressure difference, typically a higher pressure within the second inflatable structure as compared to the pressure within the first inflatable structure, in the second state, the desired hydrodynamic shape of the nose arrangement may be maintained also when the underwater vehicle travels at high speeds. The pressure within the first inflatable structure in the second state typically being higher than the pressure outside the first inflatable structure.

According to some aspects, the first inflatable structure of each of the separation sections is made of a fibre-reinforced composite material, such as fibre-reinforced rubber.

By utilizing a fibre-reinforced composite material, the first inflatable structure becomes resistant against damage.

According to some aspects, the second inflatable structure of each of the separation sections is made of an elastic material, such as rubber.

By utilizing an elastic material, the second inflatable structure is expandable upon being inflated by a gas or by a liquid.

According to some aspects, the releasable section and/or any of the separation sections comprises a payload, such as a sensor arrangement and/or a transceiver and/or an explosive device.

Thereby the nose arrangement may be arranged to deploy at least one payload onto the seabed, for example upon data collection, such as oceanography data collection.

According to some aspects, each of the separation sections further comprises a pump arranged to inflate the first inflatable structure by ambient water.

According to some aspects, each of the separation sections further comprises means for controlling the pressure within the first inflatable structure and/or within the second inflatable structure.

According to some aspects, each of the separation sections further comprises a control unit being arranged to control the means for controlling the pressure.

Thereby the buoyancy of a separation section and/or of an underwater vehicle may be controlled. For example, the separation section may be programmed such that the separation section floats to the surface after a certain time, for example after that a training is finished. Hence, there is no need for a diver that collects the separation sections at the seabed. There is no need for a separate rescue system such as a balloon attached to the underwater vehicle or to the separation section for recovery of the separation section or the underwater vehicle.

According to some aspects, the control unit is arranged to control the buoyancy of the underwater vehicle and/or of the separation section after the separation section being released from the underwater vehicle.

Hence, it may be possible to control whether the underwater vehicle and/or of the separation section being released from the underwater vehicle should sink, float or be neutral in the water.

The present disclosure further proposes an underwater vehicle comprising a propulsion system and a nose arrangement. The underwater vehicle is thus provided with all the associated effects and advantages of the nose arrangement as discussed above.

According to some aspects, the underwater vehicle is an unmanned underwater vehicle, such as a torpedo or an unmanned submarine.

The present disclosure further proposes a method for deploying a nose arrangement of an underwater vehicle. The method comprises the step of providing the nose arrangement attached to the underwater vehicle comprising a first separation section comprising a first inflatable structure and a second inflatable structure arranged within the first inflatable structure. The first inflatable structure and the second inflatable structure are stored in a first state. The method further comprises the step of inflating the first inflatable structure and the second inflatable structure to a second state, wherein the first inflatable structure is arranged to protrude along a longitudinal axis of the nose arrangement and underwater vehicle in the second state.

The method corresponds to the actions performed by the nose arrangement as discussed above and have all the associated effects and advantages of the disclosed nose arrangement.

According to some aspects, the method further comprises the step of providing a second separation section comprised in the nose arrangement, wherein the first separation section is releasably attached the second separation section, wherein the first separation section is positioned in front of the second separation section along a longitudinal axis of the nose arrangement and underwater vehicle, wherein the second separation section comprises a second inflatable structure and a second inflatable structure arranged within said first inflatable structure, and wherein said inflatable structures are in a first state. The method further comprises the step of releasing the first separation section from the underwater vehicle, thereby exposing part of the second separation section from the underwater vehicle. The method further comprises inflating the first inflatable structure and the second inflatable structure of the second separation section, wherein the second inflatable structure of the second separation section is arranged to protrude along a longitudinal axis of the nose arrangement and underwater vehicle, thereby deploying the nose arrangement.

DETAILED DESCRIPTION

Figure 1:
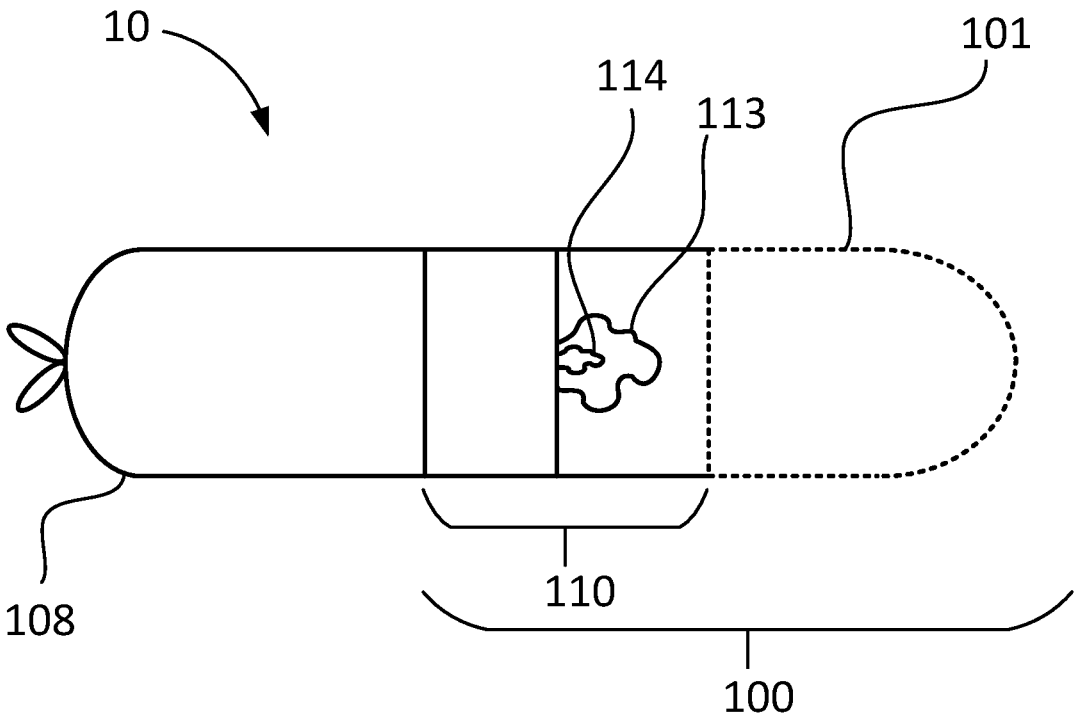
FIG. 1 shows an underwater vehicle comprising a nose arrangement according to an example of the present disclosure.

FIG. 1 shows an underwater vehicle 10 comprising a nose arrangement 100 according to an example of the present disclosure. The nose arrangement 100 comprises a first separation section 110. The separation section 110 comprises a first inflatable structure 113 and a second inflatable structure 114, wherein the second inflatable structure 114 is arranged within the first inflatable structure 113. The underwater vehicle 10 may further comprise a propulsion means 108. The underwater vehicle may, but need not, comprise a releasable section 101.

As will be discussed more in detail below, the first separation section 110 is arranged store the first inflatable structure 113 and the second inflatable structure 114 in a first state, and to inflate the first inflatable structure 113 and the second inflatable structure 114 in a second state, wherein the first inflatable structure 113 is arranged to protrude along the longitudinal axis of the nose arrangement and underwater vehicle 10 in the second state.

By protrude is meant that the first inflatable structure is arranged beyond the original front end of the underwater vehicle, i.e. of the front end of the underwater vehicle in the first state, not comprising a releasable nose 101.

As will be discussed below, the first inflatable structure 113 may have a convex shape along a longitudinal axis of the underwater vehicle in the second state, i.e. when the first inflatable structure 113 is inflated and protrudes along the longitudinal axis of the underwater vehicle.

The nose arrangement 100 may be attached to an underwater vehicle 10. Examples of such underwater vehicles are unmanned underwater vehicles, for example torpedoes or unmanned submarines. Typically, the underwater vehicle 10 may comprise the nose arrangement 100 and a propulsion system 108. The propulsion system 108 may comprise a propeller arranged to propel the underwater vehicle 10. Alternatively, the propulsion system 108 may comprise a density-driven propulsion system which is arranged to propel the underwater vehicle 10 by changing the density of the underwater vehicle 10. In one further alternative, the nose arrangement 100 may function as a density-driven propulsion system.

In one example, at least one separation section, such as the first separation section 110 is arranged to be fixedly attached to the underwater vehicle 10, i.e. the separation section 110 may not be releasable from the underwater vehicle 10.

This may be the case for example if the underwater vehicle 10 has a space-consuming size extending in the longitudinal direction of the underwater vehicle and when the underwater vehicle 10 is stored in a confined space, such as a submarine. Hence, by the nose arrangement 100, the first inflatable structure 113 and the second inflatable structure 114 may be arranged to be inflated into the second state upon, or slightly after, release of the underwater vehicle into the sea, thereby saving space in the first state and providing a hydrodynamic nose portion of the underwater vehicle in the second state of the. By the term "hydrodynamic" is meant that the nose portion of the underwater vehicle provides an efficient travel through the water.

In another example, at least one separation section, such as the first separation section 110 is arranged to be releasably attached to the underwater vehicle 10. In such case, the first separation section 110 is arranged to be released from the underwater vehicle 10.

The first separation section 110 may be arranged at the very front along the longitudinal axis of the underwater vehicle 10. Alternatively, the nose arrangement 100 may comprise a releasable section 101 being positioned in front of the first separation section 110 along a longitudinal axis of the nose arrangement and underwater vehicle while attached. In one example, the releasable section may serve as the initial nose of the nose arrangement and/or the underwater vehicle. The releasable section 101 may be arranged to be released from the underwater vehicle prior to inflation of the first inflatable structure 113 and of the second inflatable structure 114.

In one example, the releasable section 101 may be a cover, such as a cap, with the purpose of protecting the first separation section 110, for example upon storage of the underwater vehicle in a confined space as discussed above.

In another example, the releasable section 101, may, but need not, have a convex shape along the longitudinal direction of the underwater vehicle in order to provide a nose section of the underwater vehicle 10 with a desired hydrodynamic shape.

The releasable section 101 may comprise a payload, such as a sensor arrangement, a transceiver, and/or an explosive arrangement. In one example, the releasable section 101 may comprise more than one payload, for example a sensor arrangement and a transceiver.

Figure 2:
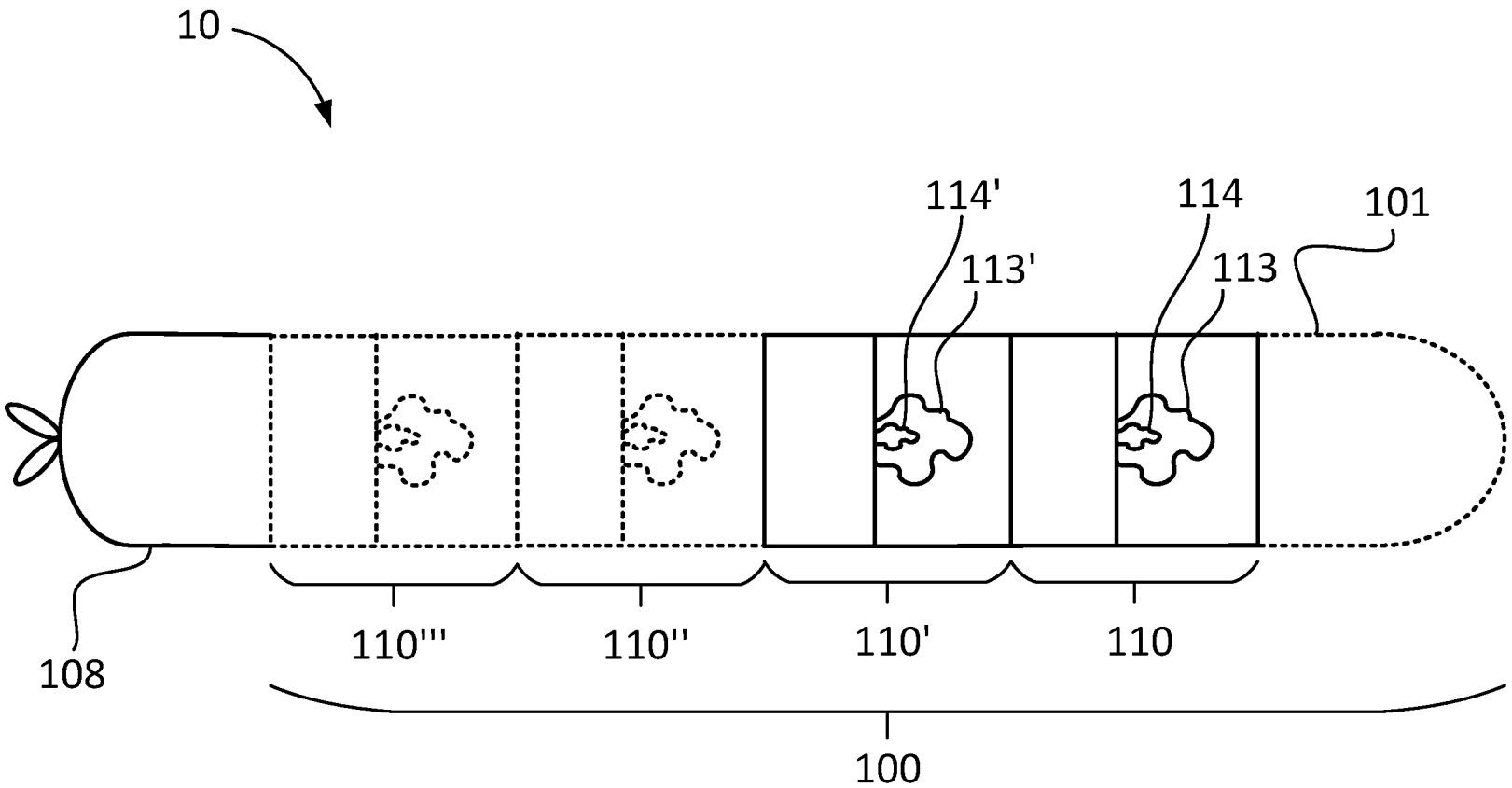
FIG. 2 shows an underwater vehicle comprising a nose arrangement according to an example of the present disclosure.

As illustrated in FIG. 2, the nose arrangement 100 may further comprise a second separation section 110' attached the first separation section 110, wherein the first separation section 110 is positioned in front of the second separation section 110' along a longitudinal axis of the nose arrangement 100 and underwater vehicle 10 while attached. The second separation section 110' may be arranged store a first inflatable structure 113' and a second inflatable structure 114' in a first state and to inflate the first inflatable structure 113' and the second inflatable structure 114' in a second state, wherein the first inflatable structure 113' may be arranged to protrude in the longitudinal axis of the nose arrangement and underwater vehicle in the second state. The second separation section 110' may, but need not, be releasably attached to the underwater vehicle. Alternatively, the second separation section may be fixedly attached to the underwater vehicle.

As shown in FIG. 2, the nose arrangement may comprise a plurality of separation sections 110, 110', 110", 110'" arranged one after the other along the longitudinal axis of the underwater vehicle 10. By a nose arrangement comprising a plurality of separation sections as illustrated in FIG. 2, the underwater vehicle may have the ability to release a plurality of separation sections 110, 110', 110" one after the other onto the seabed.

Typically, the last separation section 110'" of the nose arrangement as seen in the longitudinal axis of the underwater vehicle may be fixedly attached to the underwater vehicle. Hence, after the first and second separation sections have been released from the underwater vehicle, the first inflatable section and the second inflatable section of the last separation section may be inflated and the underwater vehicle may, for example, be arranged to travel back to the location from where it was released into the sea or take an action to facilitate recovery.

Each separation section 110, 110', 110", 110'" may, but need not, comprise a payload, such as a sensor arrangement, a transceiver, and/or an explosive arrangement. In one example, the releasable section 101 may comprise more than one payload, for example a sensor arrangement and a transceiver. By a nose arrangement 100 comprising a plurality of separation sections 110, 110', 110", 110'", a plurality of payloads may be released from the underwater vehicle such that the separation sections are placed at different locations onto the seabed. Each of the plurality of separation sections of a nose arrangement may comprise the same type of payload, such as a sensor arrangement. Alternatively, each of the plurality of separation sections may comprise different types of payloads.

In one example, the separation section being released from the underwater vehicle may have the function of a transceiver mast whereby controlling the buoyancy of the separation section may allow enabling the transceiver to be moved to the surface and reach above water waves, thus increasing the operational range of the transceiver.

In another example, the separation section being released form the underwater vehicle may comprise distancing sensors for triangulation applications. For example, the separation sections may be deployed at the seabed such that they surrounds an area where a target position may be determined by means of triangulation.

In one example, each separation section 110, 110', 110", 110'" may be provided by its own propulsion means (not shown) such that the separation section may be arranged to actively travel in the sea after being released from the underwater vehicle.

Figure 3A:
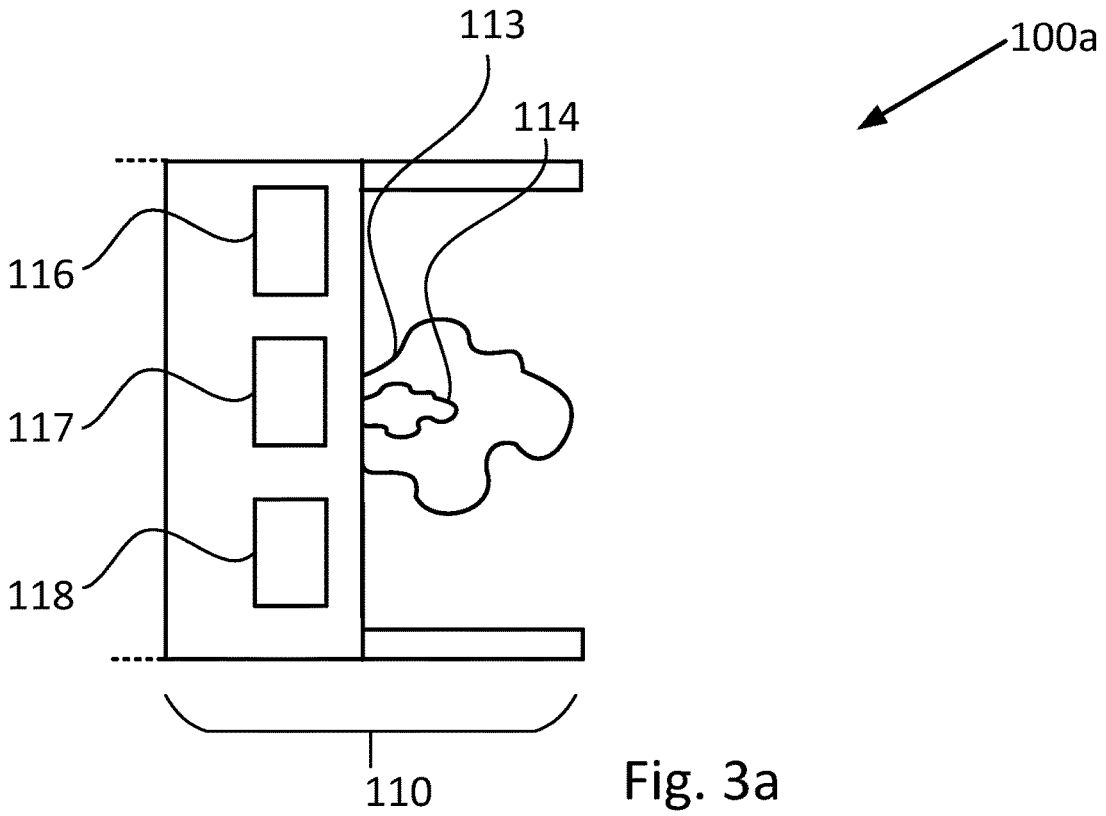
FIG. 3*a* and FIG. 3*b* show a nose arrangement in a first state and a second state, respectively.
Figure 3B:
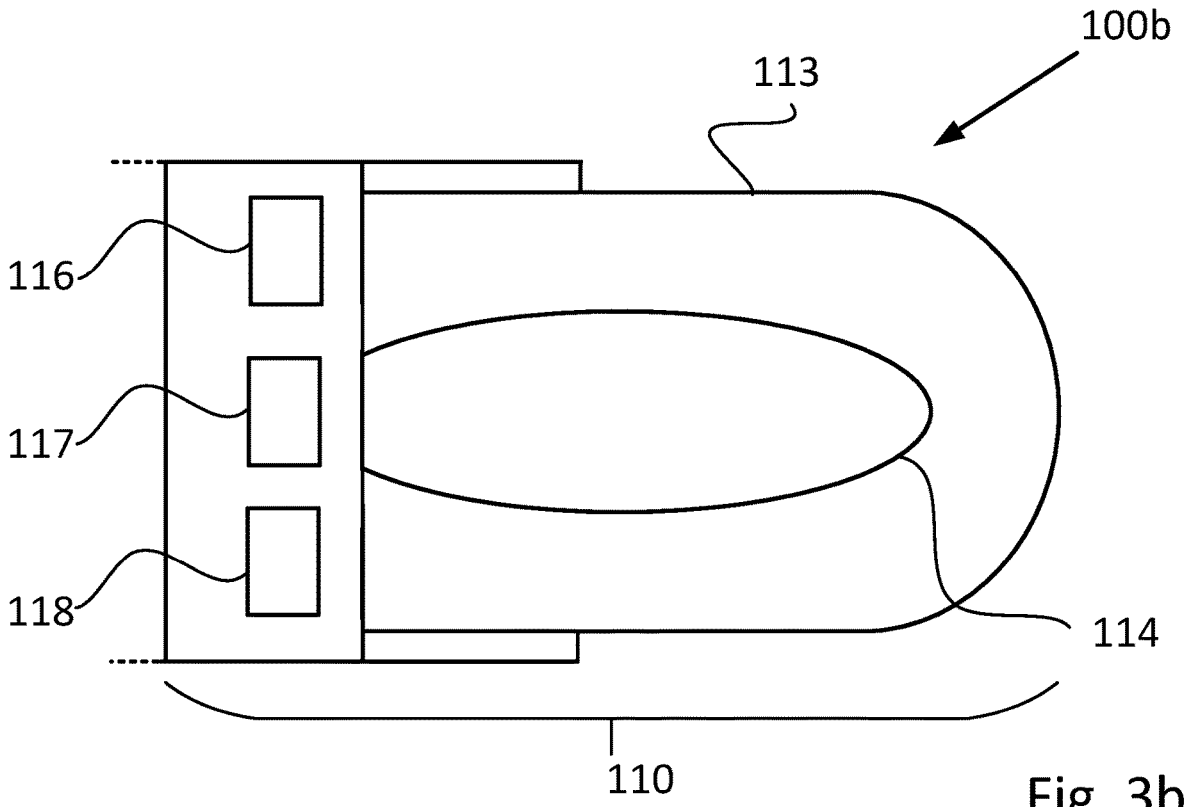

FIGS. 3*a* and 3*b* schematically illustrate the nose arrangement according to the present disclosure in a first state 100*a* and a second state 100*b*, respectively. The first state corresponds to storage of the first inflatable structure 113 and the second inflatable structure 114 within the separation section 110. The second state corresponds to an inflated state of the first inflatable structure 113 and of the second inflatable structure 114, respectively.

FIG. 3*a* illustrates the nose arrangement in the first state 100*a*. The first state corresponds to storage of the first inflatable structure and the second inflatable structure in a non-inflated state into the first separation section. In the first state, the first inflatable structure 113 and/or the second inflatable structure 114 may be folded to fit into the separation section in order to be as little space consuming as possible. In such case, the first inflatable structure 113 and the second inflatable structure may be unfolded upon inflation.

FIG. 3*b* illustrates the nose arrangement in the second state 100*b*. The second state corresponds to an inflated state of the first inflatable structure 113 and the second inflatable structure 114. The first inflatable structure 113 and the second inflatable structure 114 may be inflated simultaneously. Alternatively, the second inflatable structure 113 is inflated with a time delay as compared to the first inflatable structure 114, or vice versa.

As seen in FIG. 3*b*, the first inflatable structure 113 protrudes along the longitudinal axis of the nose arrangement and underwater vehicle in the second state. In one example, the first inflatable structure 113 has a convex shape along the longitudinal axis of the nose arrangement and underwater vehicle in the second state. Alternatively, the first inflatable structure 113 may have any other shape, for example, it may have a pointed shape along a longitudinal axis of the nose arrangement. In yet an alternative, the first inflatable structure may be provided with at least one protrusion, such as a wing (not shown). As illustrated in FIG. 3*b*, the first inflatable structure 113 protrudes beyond the original front end of the underwater vehicle, i.e. of the front end of the underwater vehicle in the first state, but without a releasable nose 101 being comprised.

As shown in FIG. 3*b*, also the second inflatable structure 114 may, but need not, protrude within the first inflatable structure along the longitudinal axis of the nose arrangement and underwater vehicle. The shape of the second inflatable structure 114 in the second state, i.e. inflated state, may depend on the pressure within the second inflatable structure. In FIG. 3*b* it is illustrated with an elongated shape, however it should be understood that it may have any other shape, such as a round shape.

The first inflatable structure 113, 113' of each of the separation sections 110, 110' may be arranged to be inflated by ambient water from the sea. In another example, the first inflatable structure 113, 113' may be inflated by gas or a liquid, wherein the gas or liquid may be stored in a container in the separation section or in any other space within the underwater vehicle. In yet an alternative, the second inflatable structure 113, 113' may be arranged to be inflated by air from the internal of the underwater vehicle, such as from the separation section or from any other portion of the underwater vehicle.

The second structure 114, 114' of each of the separation sections 110, 110' may be arranged to be inflated by ambient a gas or by a liquid. The gas or liquid may be stored in a container in the separation section or in any other space within the underwater vehicle. In an alternative, the second inflatable structure 113, 113' may be arranged to be inflated by air from the internal of the underwater vehicle, such as from the separation section or from any other portion of the underwater vehicle.

It should be noted that if the nose arrangement 100 comprises a plurality of separation sections 110, 110', 110", 110'", each separation section may be arranged to be inflated by ambient water, gas or liquids independently of the other separation sections.

In one example, the first inflatable structure 113 and the second inflatable structure 114 may be arranged to be inflated in response to release of the releasable section from the nose arrangement. Alternatively, first inflatable structure 113 and the second inflatable structure 114 structure are arranged to be inflated after predetermined time after the underwater vehicle and/or a separation section being released into the water. As will be discussed below, this may be controlled by a control unit 118.

The first inflatable structure 113 may be made of a fibre-reinforced composite material, such as fibre-reinforced rubber. By such a material, the first inflatable structure 113 typically may be relatively inelastic. The material of the first inflatable structure may be resistant such that the first inflatable structure does not break upon storage or in its inflated state.

The second inflatable structure 114 may be made of an elastic material, such as rubber. Thus, the second inflatable structure may be arranged to deform to significantly increase in volume upon an increase in a pressure difference between inside and outside pressure of the second inflatable structure. By the elastic material, the second inflatable structure may be inflated to different pressures, thereby having different sizes depending on the pressure within the second inflatable structure. In one example, the second inflatable structure may be able to be inflated up to the same size as the first inflatable structure. In a further alternative, the second inflatable structure may be arranged to inflate to the size of the first inflatable structure upon rupture of the first inflatable structure.

A first pressure within the first inflatable structure 113, 113' and/or a second pressure within the second inflatable structure 114, 114' of each of the separation sections may be controlled in the second state. In one example, the first inflatable structure may be inflated by ambient water, a gas or a liquid to a predetermined amount while the pressure in the second inflatable structure may be controlled depending on the desired buoyancy of an underwater vehicle or of a separation section being released from an underwater vehicle.

The pressure within the second inflatable structure 114, 114' of each of the separation sections 110, 110' may be different as compared to the pressure within the first inflatable structure 114, 114' in the second state.

By controlling the pressure within the first and/or second inflatable structures the relation between weight and volume, of the underwater vehicle and/or of a separation section being released from the underwater vehicle, may be controlled. In one example, the second inflatable structure provides an overpressure within the first inflatable structure. By an overpressure provided by the second inflatable structure, the first inflatable structure may keep its shape, e.g. a convex shape, also when the underwater vehicle travels at high speeds. In one example, the pressure is controlled by letting in/letting out gas from the second inflatable structure. As will be discussed below, the pressure may be controlled by means of a control unit.

By controlling the pressure, the buoyancy of the underwater vehicle and/or of a separation section being released from the underwater vehicle may be controlled as well, i.e. if the underwater vehicle or separation section being released from the underwater vehicle should float, sink or be neutral in the sea.

As illustrated in FIGS. 3*a* and 3*b*, the separation section may comprise a pump 116, means for controlling the pressure 117 and/or a control unit 118. The control unit 118 may be arranged to control the pressure of the first separation section and/or of the second separation section. Hence, when the underwater vehicle comprises a plurality of separation sections, the buoyancy of the underwater vehicle may be controlled as well as the buoyancy of each of the separation sections being released from the underwater vehicle.

In one example, the control unit may be programmed to control time for inflation of the first separation section and second separation section of a separation section. The control unit may further be arranged to control release of the separation section and/or release of a releasable section 101 from the underwater vehicle. In one example, when the separation section is fixedly attached to the underwater vehicle, the control unit may be provided in any other portion of the underwater vehicle, i.e. not be located in the separation section.

Each of the separation sections 110, 110' may comprise a pump 116 arranged to inflate the first inflatable structure 113, 113' by ambient water. The separation section may further comprise inlet piping in order to pump ambient water from the sea. The separation section may also comprise outlet piping in order to discharge water from the first inflatable structure back to the sea. The pump 116 may be controlled by the control unit 118.

Each of the separation sections may comprise means for controlling the pressure 117 within the first inflatable structure and/or within the second inflatable structure. The means for controlling the pressure 117 within the first and/or second inflatable structures may for example be a valve and/or a pressure gauge.

In one example, separation sections comprising payloads, such as sensor arrangements may be placed at the seabed for the purpose of data collection, e.g. oceanography data collection.

In one example, the control unit 118 may be programmed such that a separation section may float to the surface after a certain time, for example after that the data collection performed by the separation section is finished. Thereby the separation sections and thus the payloads may be picked up from the sea. In yet an example, the control unit may be programmed such that the separation section is arranged to float to the surface, transmit the collected data to a receiver, for example being located at ship, and sink back to the seabed for further data collection.

In yet an alternative, it is possible to determine orientation/location of the deployed separation section onto the seabed, by means of sonar, due to that the separation section may comprise inflatable structures comprising a lower density medium, such as a gas.

The outer portion of the releasable section 101 may be a metal or composite material and for example be made of the same material as the outer portion of the underwater vehicle comprising the propulsion system and/or the separation sections. In the example of the releasable section 101 having the purpose of protecting the first separation section the outer portion of the releasable section may be made of for example rubber.

The outer portion of each of the separation sections 110, 110', 110", 110'" may, but need not, be made of the same material as the outer portion of the underwater vehicle 10 comprising the propulsion system. For example, the outer portions of each separation section is made of a composite material or metal.

Figure 4:
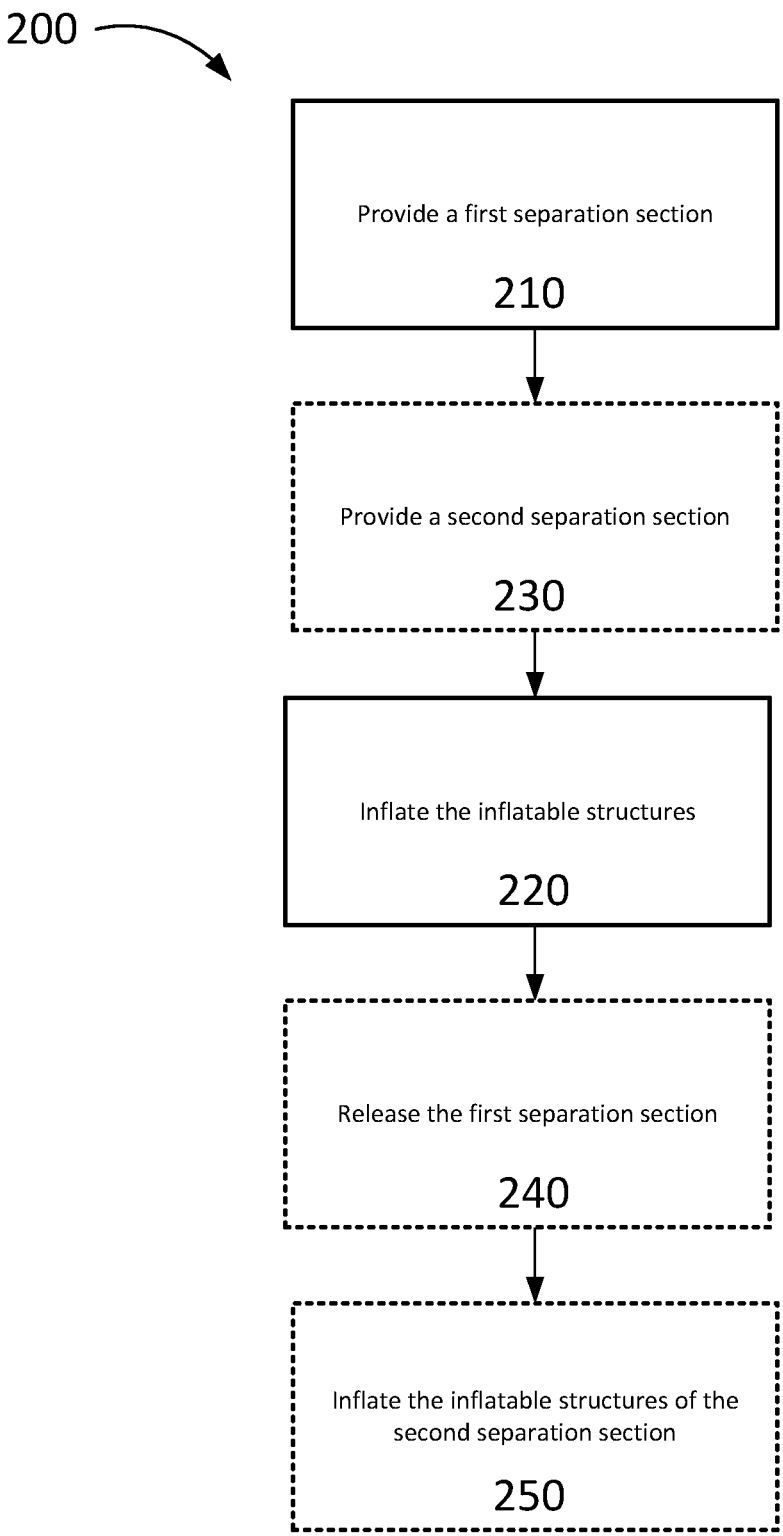
FIG. 4 shows schematically a method for deploying the nose arrangement according to the present disclosure.

FIG. 4 illustrates the method steps of a method 200 for deploying a nose arrangement of an underwater vehicle. The method comprises the steps of providing 210 the nose arrangement attached to the underwater vehicle. The nose arrangement comprises a first separation section comprising a first inflatable structure and a second inflatable structure arranged within the first inflatable structure, wherein the first inflatable structure and the second inflatable structure are stored in a first state. The method further comprises the step of inflating 220 the first inflatable structure and the second inflatable structure to a second state, wherein the first inflatable structure is arranged to protrude along a longitudinal axis of the nose arrangement and underwater vehicle in the second state.

The method may further comprise a step of providing 230 a second separation section comprised in the nose arrangement, wherein the second separation section is releasably attached the first separation section. The first separation section is positioned in front of the second separation section along a longitudinal axis of the nose arrangement and underwater vehicle, wherein the second separation section comprises a second inflatable structure and a second inflatable structure arranged within said first inflatable structure, and wherein said inflatable structures are in a first state. The method may further comprise the step of releasing 240 the first separation section from the underwater vehicle, thereby exposing part of the second separation section from the underwater vehicle. The method may further comprise the step of inflating 250 the first inflatable structure and the second inflatable structure of the second separation section, wherein the second inflatable structure of the second separation section is arranged to protrude along a longitudinal axis of the nose arrangement and underwater vehicle, thereby deploying the nose arrangement.

The invention claimed is:

1. A nose arrangement (100) for an underwater vehicle (10), comprising:

a first separation section (110) comprising a first inflatable structure (113) and a second inflatable structure (114) arranged within the first inflatable structure (113), wherein:

the first separation section (110) is arranged to store the first inflatable structure (113) and the second inflatable structure (114) in a first state, and to inflate the first inflatable structure (113) and the second inflatable structure (114) in a second state, the first inflatable structure (113) is arranged to protrude along the longitudinal axis of the nose arrangement and underwater vehicle in the second state, and the pressure within the second inflatable structure (114) of the first separation section (110) is different as compared to the pressure within the first inflatable structure (113) in the second state.

2. The nose arrangement (100) according to claim 1, further comprising a releasable section (101), wherein the releasable section (101) in an attached state being positioned in front of the first separation section (110) along a longitudinal axis of the nose arrangement (100) and underwater vehicle (10).

3. The nose arrangement (100) according to claim 2, wherein first inflatable structure (113) and the second inflatable structure (114) are arranged to be inflated in response to release of the releasable section (101) from the nose arrangement (100).

4. The nose arrangement (100) according to claim 1, wherein the at least one separation section (110) is arranged to be releasably attached to the underwater vehicle (10).

5. The nose arrangement (100) according to claim 1, wherein the at least one separation section (110) is arranged to be fixedly attached to the underwater vehicle (10).

6. The nose arrangement (100) according to claim 1, further comprising:

a second separation section (110') attached to the first separation section (110), wherein:

the first separation section (110) is positioned in front of the second separation section (110') along a longitudinal axis of the nose arrangement (100) and underwater vehicle (10) while attached, the second separation section (110') is arranged to store a first inflatable structure (113') and a second inflatable structure (114'), the second inflatable structure (114') of the second separation section (110') is arranged within the first inflatable structure (113') of the second separation section (110'), in a first state and to inflate the first inflatable structure (113') and the second inflatable structure (114') of the second separation section (110') in response to release of the first separation section (110) from the nose arrangement (100) in a second state, and the first inflatable structure (113') of the second separation section (110') is arranged to protrude in the longitudinal axis of the nose arrangement and underwater vehicle in the second state.

7. The nose arrangement (100) according to claim 1, wherein the first inflatable structure (113, 113') of each of the first and/or second separation sections (110, 110') is arranged to be inflated by ambient water.

8. The nose arrangement (100) according to claim 1, wherein the second inflatable structure (114, 114') of each of the first and/or second separation sections (110, 110') is arranged to be inflated by a gas or by a liquid.

9. The nose arrangement (100) according to claim 1, wherein a first pressure within the first inflatable structure (113, 113') and/or a second pressure within the second inflatable structure (114, 114') of each of the first and/or second separation sections is controlled in the second state.

10. The nose arrangement (100) according to claim 6, wherein the pressure within the second inflatable structure (114') of the second separation section (110') is different as compared to the pressure within the first inflatable structure (113') in the second state.

11. The nose arrangement (100) according to claim 1, wherein the first inflatable structure (113, 113') of each of the first and/or second separation sections (110, 110') is made of a fiber-reinforced composite material.

12. The nose arrangement (100) according to claim 1, wherein the second inflatable structure (114, 114') of each of the first and/or second separation sections (110, 110') is made of an elastic material.

13. The nose arrangement (100) according to claim 1, wherein the releasable section (101) and/or any of the first and/or second separation sections (110, 110') comprises a payload.

14. The nose arrangement (100) according to claim 1, wherein each of the first and/or second separation sections (110, 110') further comprises a pump (116) arranged io inflate the first inflatable structure (113, 113') by ambient water.

15. The nose arrangement (100) according to claim 1, wherein each of the first and/or second separation sections (110, 110') further comprises means for controlling the pressure (117) within the first inflatable structure (113, 113') and/or within the second inflatable structure (114, 114').

16. The nose arrangement (100) according to claim 15, wherein each of the separation sections (110, 110') further comprises a control unit (118) being arranged to control the means for controlling the pressure (117).

17. The nose arrangement (100) according to claim 16, wherein the control unit (118) is arranged to control the buoyancy of the underwater vehicle and/or of the separation section (110, 110') after the separation section being released from the underwater vehicle (10).

18. An underwater vehicle (10) comprising a propulsion system (108) and a nose arrangement (100) according to claim 1.

19. The underwater vehicle (10) according to claim 18, wherein the underwater vehicle is an unmanned underwater vehicle.

20. A method (200) for deploying a nose arrangement of an underwater vehicle, the method comprising the steps of:

providing (210) the nose arrangement attached to the underwater vehicle, wherein the nose arrangement comprises a first separation section comprising a first inflatable structure and a second inflatable structure arranged within the first inflatable structure, wherein the first inflatable structure and the second inflatable structure are stored in a first state, and inflating (220) the first inflatable structure and the second inflatable structure to a second state, wherein the inflatable structure is arranged to protrude along a longitudinal axis of the nose arrangement and underwater vehicle in the second state, and wherein the pressure within the second inflatable structure of the first separation section is different as compared to the pressure within the first inflatable structure in the second state.

21. The method according to claim 20, wherein the method further comprises the steps of:

providing (230) a second separation section comprised in the nose arrangement, wherein the first separation section is releasably attached the second separation section, wherein the first separation section is positioned in front of the second separation section along a longitudinal axis of the nose arrangement and underwater vehicle, wherein the second separation section comprises a second inflatable structure and a second inflatable structure arranged within said first inflatable structure, and wherein said inflatable structures are in a first state, releasing (240) the first separation section from the underwater vehicle, thereby exposing part of the second separation section from the underwater vehicle, and inflating (250) the first inflatable structure and the second inflatable structure of the second separation section, wherein the second inflatable structure of the second separation section is arranged to protrude along a longitudinal axis of the nose arrangement and underwater vehicle, thereby deploying the nose arrangement.

22. The nose arrangement (100) according to claim 11, wherein the fiber-reinforced composite material is fibre-reinforced rubber.

23. The nose arrangement (100) according to claim 12, wherein the elastic material is rubber.

24. The nose arrangement (100) according to claim 13, wherein the payload is at least one of a sensor arrangement, a transceiver, or an explosive device.

25. The underwater vehicle (10) according to claim 19, wherein the unmanned underwater vehicle is a torpedo or unmanned submarine.

26. A nose arrangement (100) for an underwater vehicle (10), comprising:

a first separation section (110) comprising a first inflatable structure (113) and a second inflatable structure (114) arranged within the first inflatable structure (113), wherein:

the first separation section (110) is arranged to store the first inflatable structure (113) and the second inflatable structure (114) in a first state, and to inflate the first inflatable structure (113) and the second inflatable structure (114) in a second state, the first inflatable structure (113) is arranged to protrude along the longitudinal axis of the nose arrangement and underwater vehicle in the second state, and at least one separation section (110) is arranged to be releasably attached to the underwater vehicle (10).

27. A nose arrangement (100) for an underwater vehicle (10), comprising:

a first separation section (110) comprising a first inflatable structure (113) and a second inflatable structure (114) arranged within the first inflatable structure (113), and a second separation section (110') attached to the first separation section (110), wherein:

the first separation section (110) is arranged to store the first inflatable structure (113) and the second inflatable structure (114) in a first state, and to inflate the first inflatable structure (113) and the second inflatable structure (114) in a second state, the first inflatable structure (113) is arranged to protrude along the longitudinal axis of the nose arrangement and underwater vehicle in the second state, the first separation section (110) is positioned in front of the second separation section (110') along a longitudinal axis of the nose arrangement (100) and underwater vehicle (10) while attached, the second separation section (110') is arranged to store a first inflatable structure (113') and a second inflatable structure (114'), the second inflatable structure (114') of the second separation section (110') is arranged within the first inflatable structure (113') of the second separation section (110'), in a first state and to inflate the first inflatable structure (113') and the second inflatable structure (114') of the second separation section (110') in response to release of the first separation section (110) from the nose arrangement (100) in a second state, and the first inflatable structure (113') of the second separation section (110') is arranged to protrude in the longitudinal axis of the nose arrangement and underwater vehicle in the second state.

* * * * *